US007159493B1

(12) United States Patent
Huang

(10) Patent No.: US 7,159,493 B1
(45) Date of Patent: Jan. 9, 2007

(54) DRIVING BIT LINKING DEVICE IN A BOX WRENCH

(76) Inventor: Daniel Huang, P.O. Box 697, Fongyuan City, Taichung County (TW) 420

( * ) Notice: Subject to any disclaimer, the term of this patent is extended or adjusted under 35 U.S.C. 154(b) by 0 days.

(21) Appl. No.: 11/289,585

(22) Filed: Nov. 30, 2005

(51) Int. Cl.
*B25B 23/00* (2006.01)
*B25G 3/26* (2006.01)

(52) U.S. Cl. ..... 81/438; 81/177.85

(58) Field of Classification Search ..... 81/438, 81/177.85
See application file for complete search history.

(56) References Cited

U.S. PATENT DOCUMENTS 6,199,872 B1 * 3/2001 Hasan ..... 279/30
6,354,177 B1 * 3/2002 Peters ..... 81/439
6,622,597 B1 * 9/2003 Chen ..... 81/58.3
6,644,150 B1 * 11/2003 Chen ..... 81/438
6,840,143 B1 * 1/2005 Lin ..... 81/438
6,973,858 B1 * 12/2005 Huang ..... 81/177.85
7,111,530 B1 * 9/2006 Huang ..... 81/438
2003/0097914 A1 * 5/2003 Hu ..... 81/438

* cited by examiner

*Primary Examiner*—David B. Thomas

(57) ABSTRACT

A driving bit linking device in a box wrench includes a box wrench on a handle having a central bore, a pair of checking slots of different level in the opposing middle peripheries, an annular collar on a lower periphery and an annular groove in an upper periphery for disposing a retaining ring, a bottom spring disposed in the circular section of the central bore, a pair of compression springs wrapped on the outer periphery each including a transverse checking rod respectively inserted into the hexagonal section of the central bore through the checking slots and a cap wrapped on the box wrench and secured by the retaining ring. It is characterized that this device is capable of linking up a C type bit, a E type bit and even a double tips bit.

6 Claims, 16 Drawing Sheets

9-9

12-12

DRIVING BIT LINKING DEVICE IN A BOX WRENCH

BACKGROUND OF THE INVENTION

The present invention relates to driving tools and more particularly to a driving bit linking device in a box wrench which is provided to engage and/or disengage different types of driving bit within the box wrench which is operated manually or by power.

The using a box wrench to actuate a driving bit for fastening or unfastening a working piece such as a screw is usually used by carpenter, electrician and blacksmith. The issue coming up is how to improve the structure of the linking device in the box wrench in order to facilitate a readily engagement or disengagement of the driving bit with the wrench.

FIGS. 1 and 2 show a prior art linking device in a box wrench which comprises a box wrench 10, a conical spring 12 embedded in the bottom of the wrench 10 and restricted by an annular ring 13, an annular ring 15 on an outer periphery, a slant slot 11 in a periphery above the annular ring 15, a compressed spring 18 wrapped on the outer periphery stopped on the top of the annular ring 15 including a U-shaped checking rod 181 horizontally attached on the top thereof, a cap 17 sleeved on the outer periphery of the wrench 10 and restrained by a retaining ring 14 which is secured into an annular groove 141 abutting the upper rim of the wrench 10, an annular groove 16 under the annular ring 15 for engaging therein another retaining ring 161 for restraining the annular ring 15 from moving downward, under the wrench 10, there is a cylindrical rod 108 having crossed grooves 109 through entire outer periphery for guiding a sleeve 103 which has a plurality of spaced apart teeth 104 around outer periphery abutting lower rim and several convex on inner periphery engaged with the crossed grooves 109, an annular cap 105 closed the top of a hollow cylindrical body 106 which connects to a handle 107 in which is a checking and rotation control mechanism and a spring. When a driving bit 101 is under pressure, the crossed grooves 109 follow the convex to rotate the cylindrical rod 108 as to actuate the driving bit 101 to fasten a working object. The driving bit 101 is able to insertion into the wrench and secured by the checking rod 108 without breaking off. When press the cap 17 downward to force the checking rod disengaged with the concaves 102 so as to permit the driving bit 101 to remove out of the wrench 10 (as shown in FIG. 3).

The driving bit has different types such as the C type bit which has concaves in outer periphery and E type bit which has an annular groove on outer periphery. This structure of the wrench 10 only fits to the C type bit and could not secure the E type bit, especially the double tip bit which would damage the spring in the wrench for instance, to entangled with the spring or to cause the spring becoming deformed. So that this type of box wrench is limited in use.

Another prior art box wrench (as shown in FIGS. 4 and 5) comprises a box wrench 20 and a cap 27. The box wrench 20 has a conical spring 22 in the bottom and restrained by an annular ring 23, a slant through hole 21 in a middle periphery, a compressed spring 28 wrapped on the lower outer periphery stopped on the top of an annular ring 25 and including a U-shaped checking rod 29 on the top and inserted into the slant through hole 21 and a retaining ring 241 engaged into an annular groove 241 abutting the upper ring of the wrench 20 for preventing the cap 27 from breaking off, a driving bit 201 inserted into the wrench 20 having an annular groove 202 in lower periphery arrested by the U-shaped checking rod 29. When press the cap 27 downward, the checking rod 29 is forced to move downward to so as to disengaged with the annular groove 202 to permit the driving bit 20 removing from the wrench 20. This type of box wrench 20 also not fits to the double tips driving bit, because it also damages the spring 22 or causes the spring 22 deformed (as shown in FIG. 6). Besides, it not fits to the concaved driving bit. Therefore, the utility of this type of box wrench 20 is also limited.

SUMMARY OF THE PRESENT INVENTION

The present invention has a main object to provide a driving bit linking device in a box wrench which suits to the driving bit either having an annular groove or a plurality of concaves in the outer periphery.

Another object of the present invention is to provide a driving bit linking device in a box wrench which also suites to connect the double tips driving bit.

Accordingly, the driving bit linking device of the present invention comprises generally a box wrench embedded into a tubular base and having a spring inserted in, an annular ring on lower periphery, a pair of slant checking slot in opposing middle peripheries and an annular groove abutting upper rim, a cap wrapped on the wrench and secured by a retaining ring.

The feature is that a pair of springs wrapped on the wrench each of which has a transverse checking rod engaged with the slant slots. Besides, the spring inside the wrench includes a large diameter lower portion and a less diameter extensive upper portion.

Upon the above structure, the two checking rods facilitate the wrench able to linking up different type of bit including the double tips bit.

The present invention will become more fully understood by reference to the following detailed description thereof when read in conjunction with the attached drawings.

DETAILED DESCRIPTION OF THE PREFERRED EMBODIMENT

Figure 1:
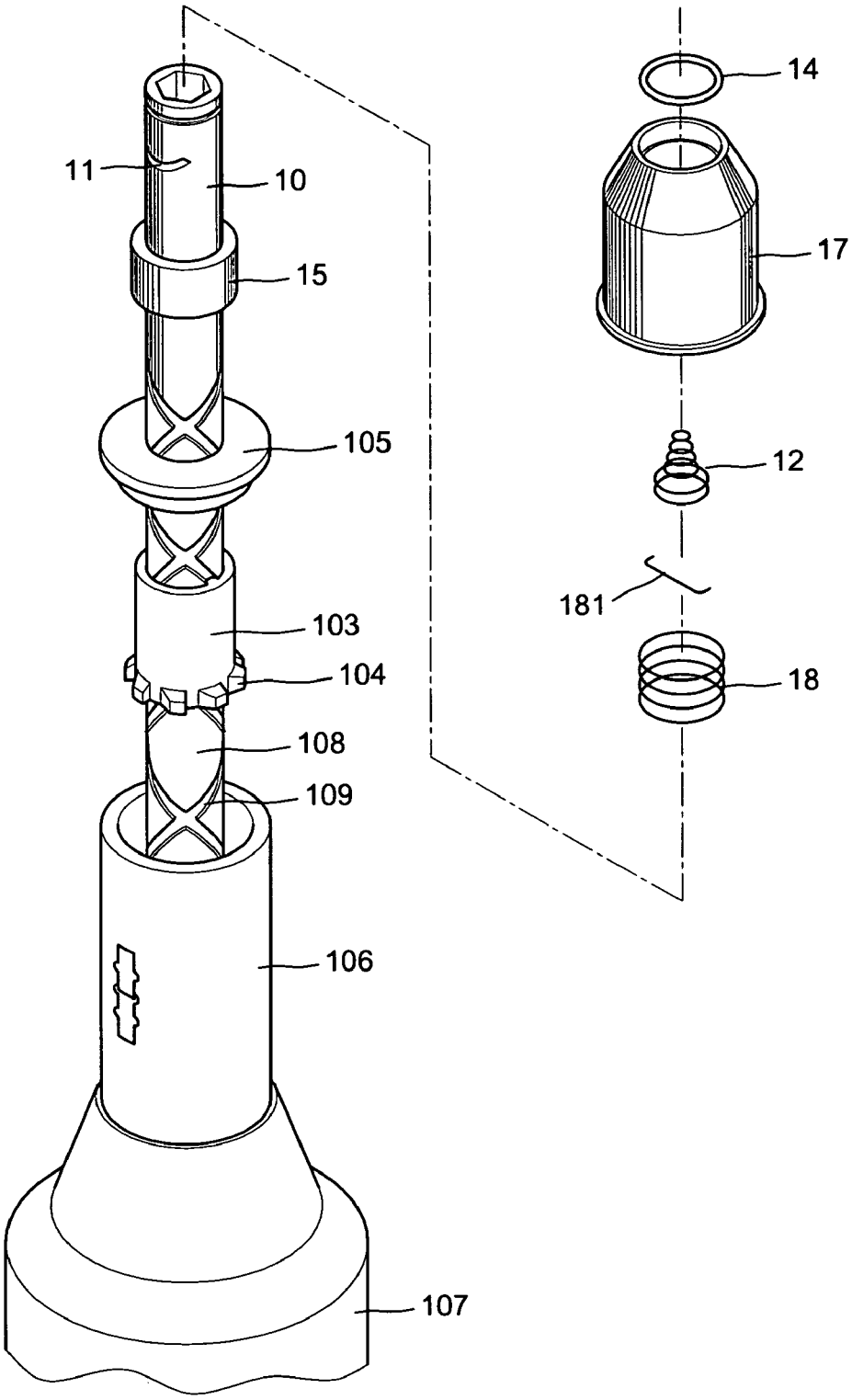
FIG.1 Prior Art
FIG. 1 is an exploded perspective view to show a driving bit linking device according to a prior art.
Figure 2:
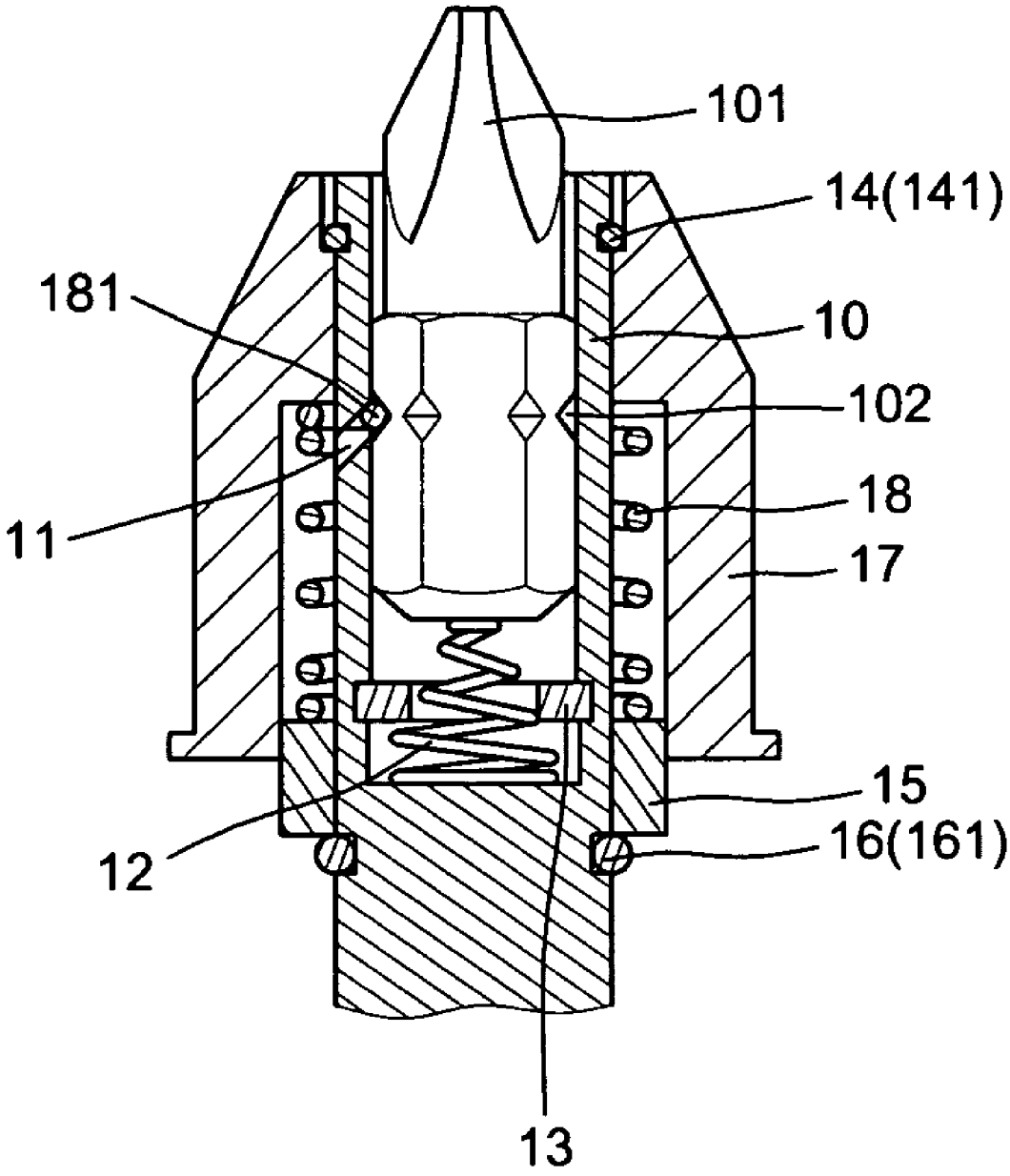
FIG.2 Prior Art
FIGS. 2 and 3 are the sectional views to show the assembly and operation of FIG. 1, FIGS. 4, 5 and 6 are the sectional views to show a driving bit linking device according to another prior art.
Figure 3:
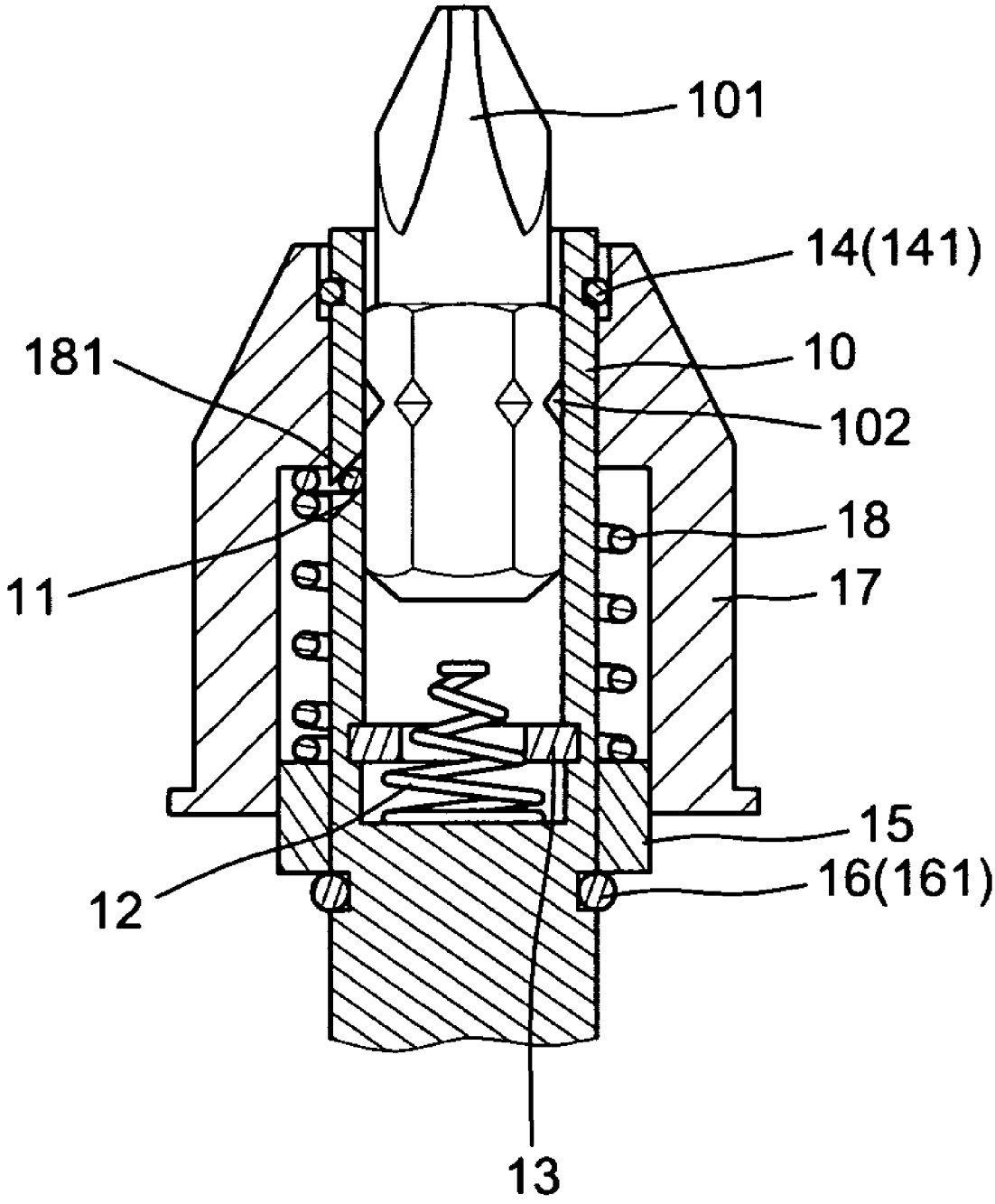
FIG.3 Prior Art
Figure 4:
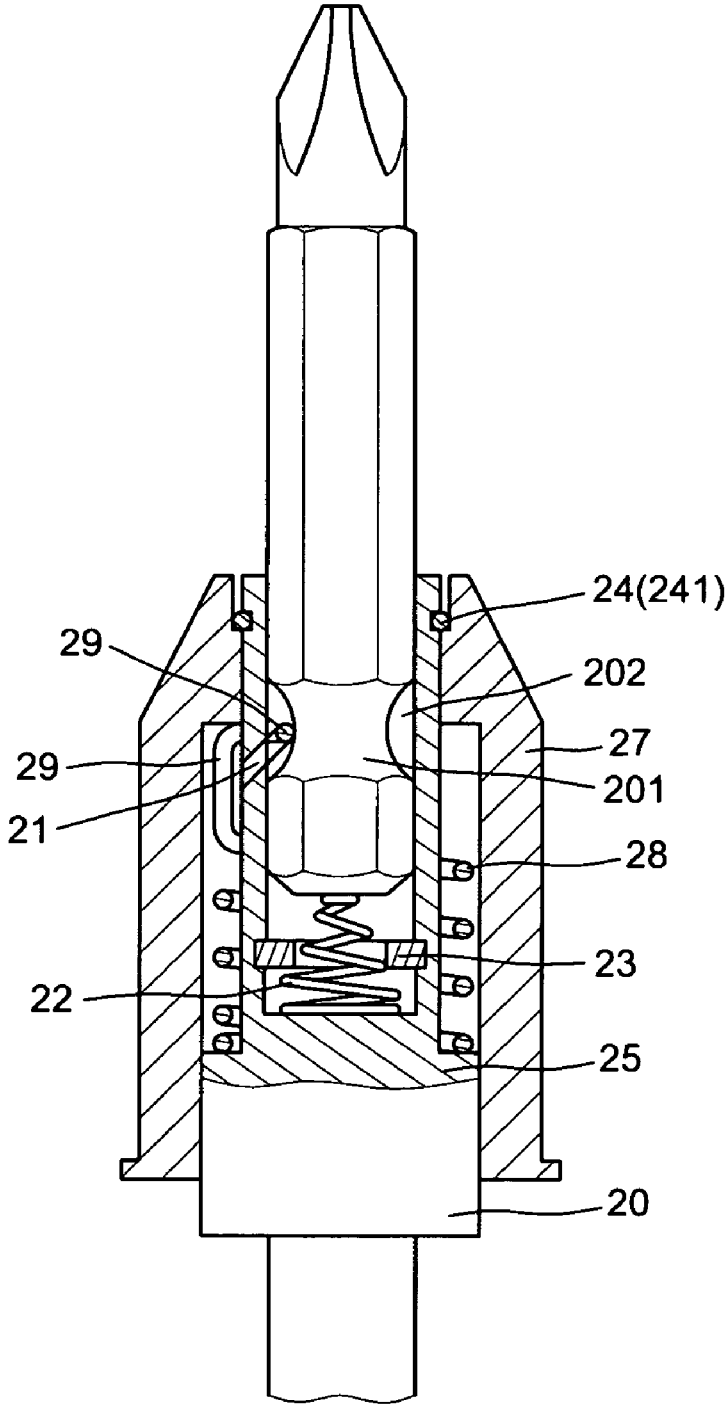
FIG.4 Prior Art
Figure 5:
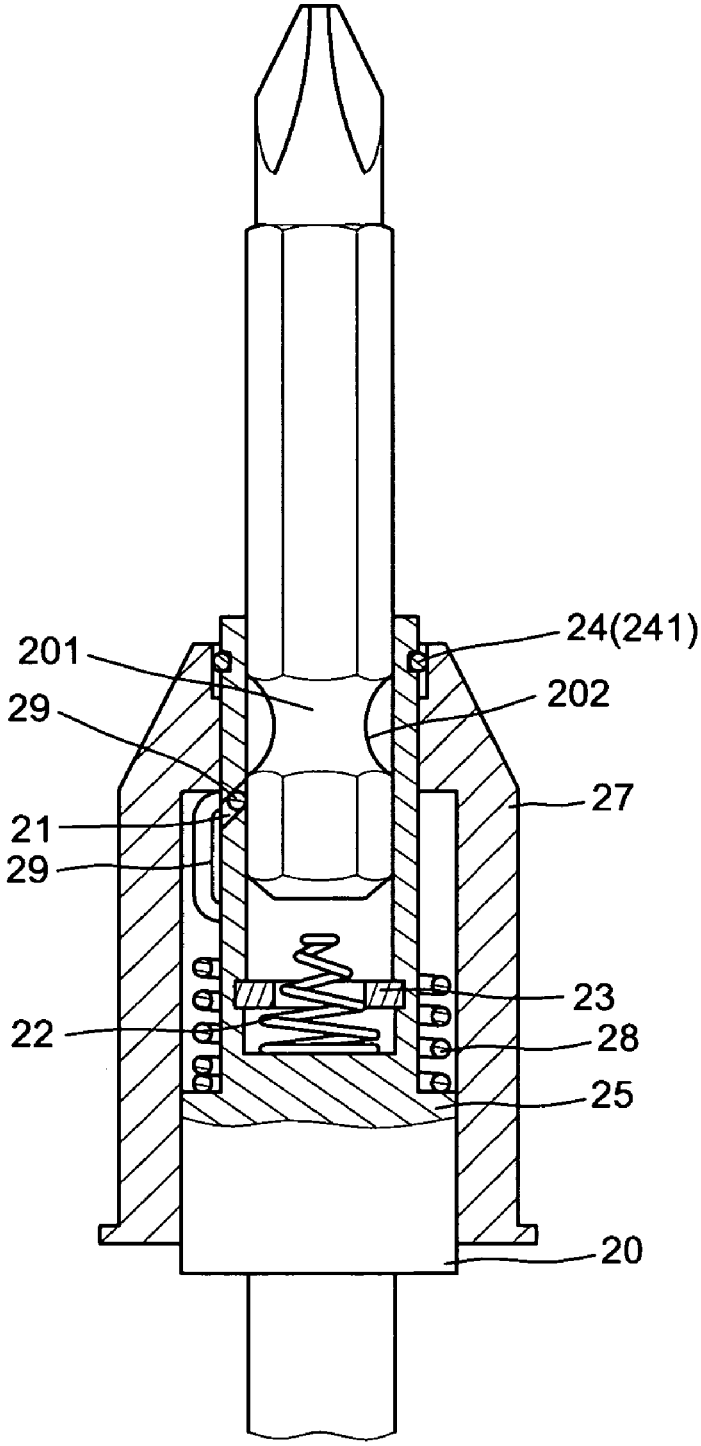
FIG.5 Prior Art
Figure 6:
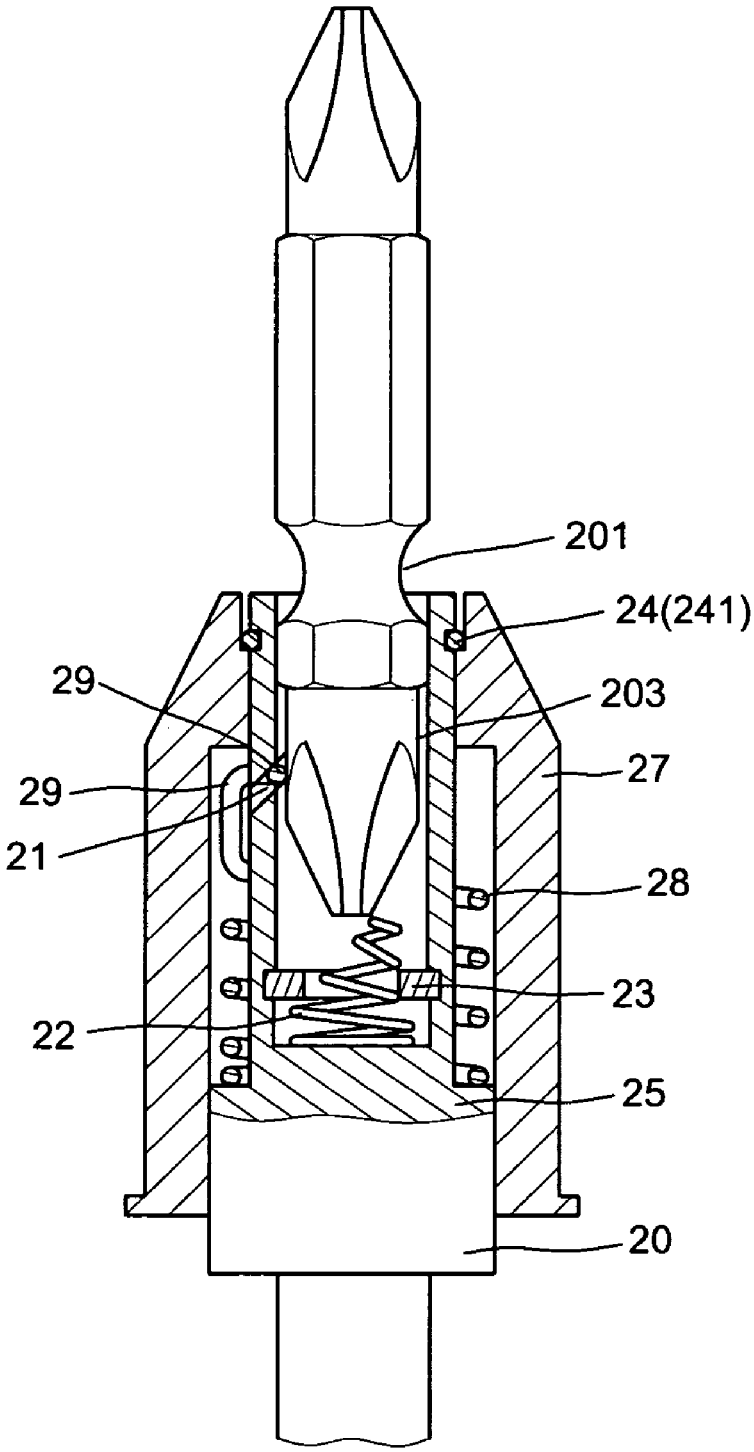
FIG.6 Prior Art
Figure 7:
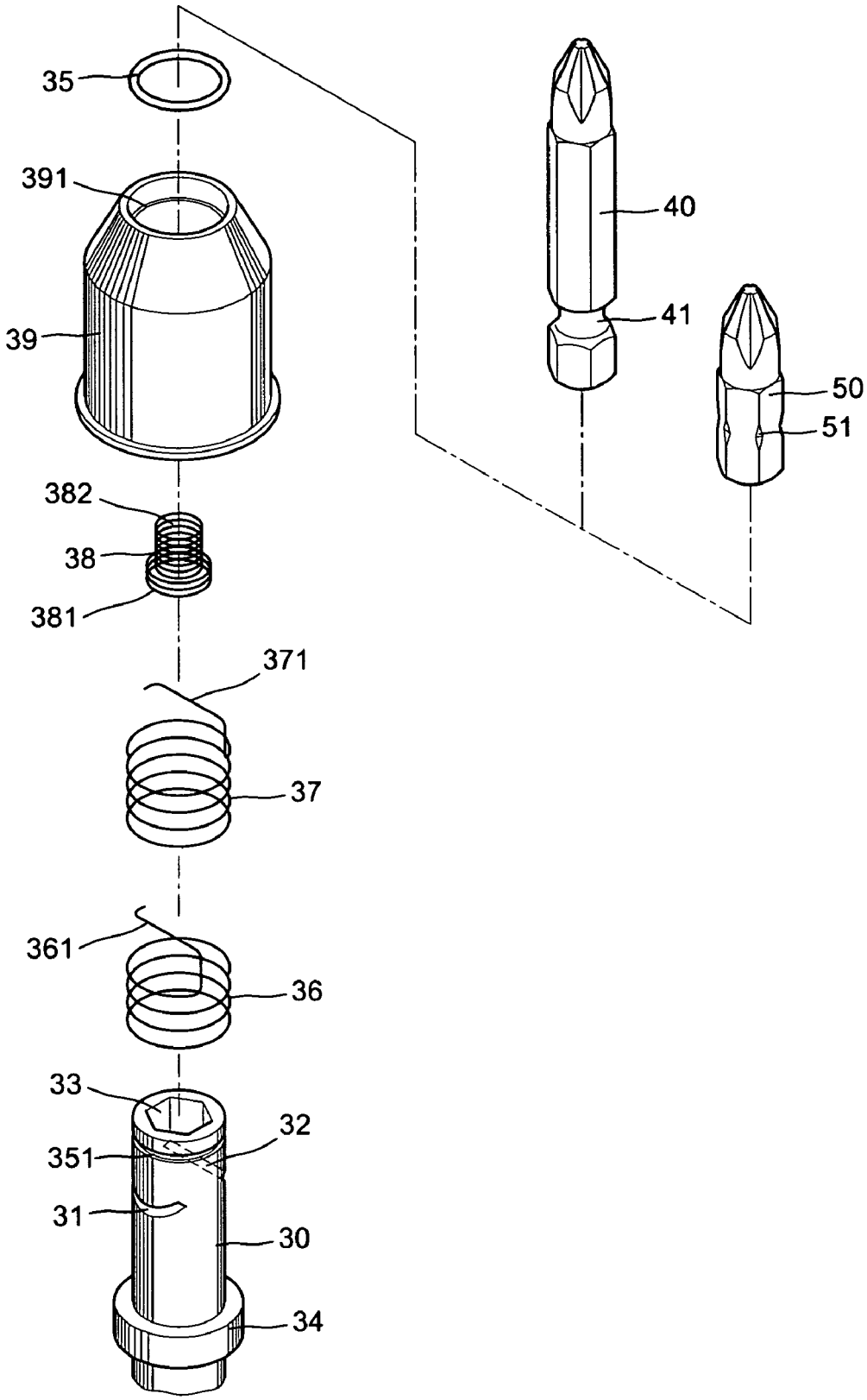
FIG. 7 is an exploded perspective view to show the preferred embodiment of the present invention.
Figure 8:
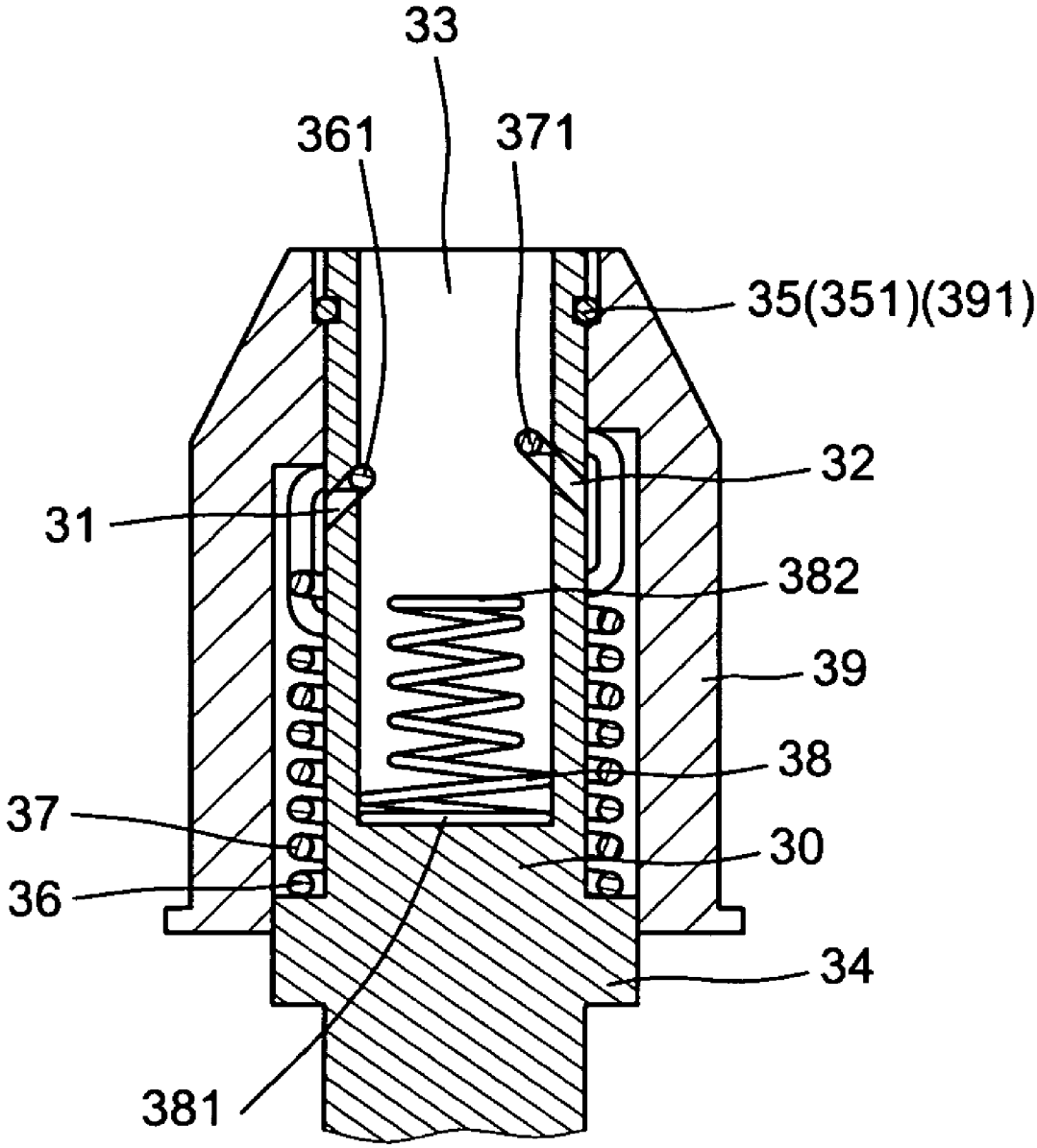
FIG. 8 is a sectional view to show the assembly of FIG. 7.
Figure 9:
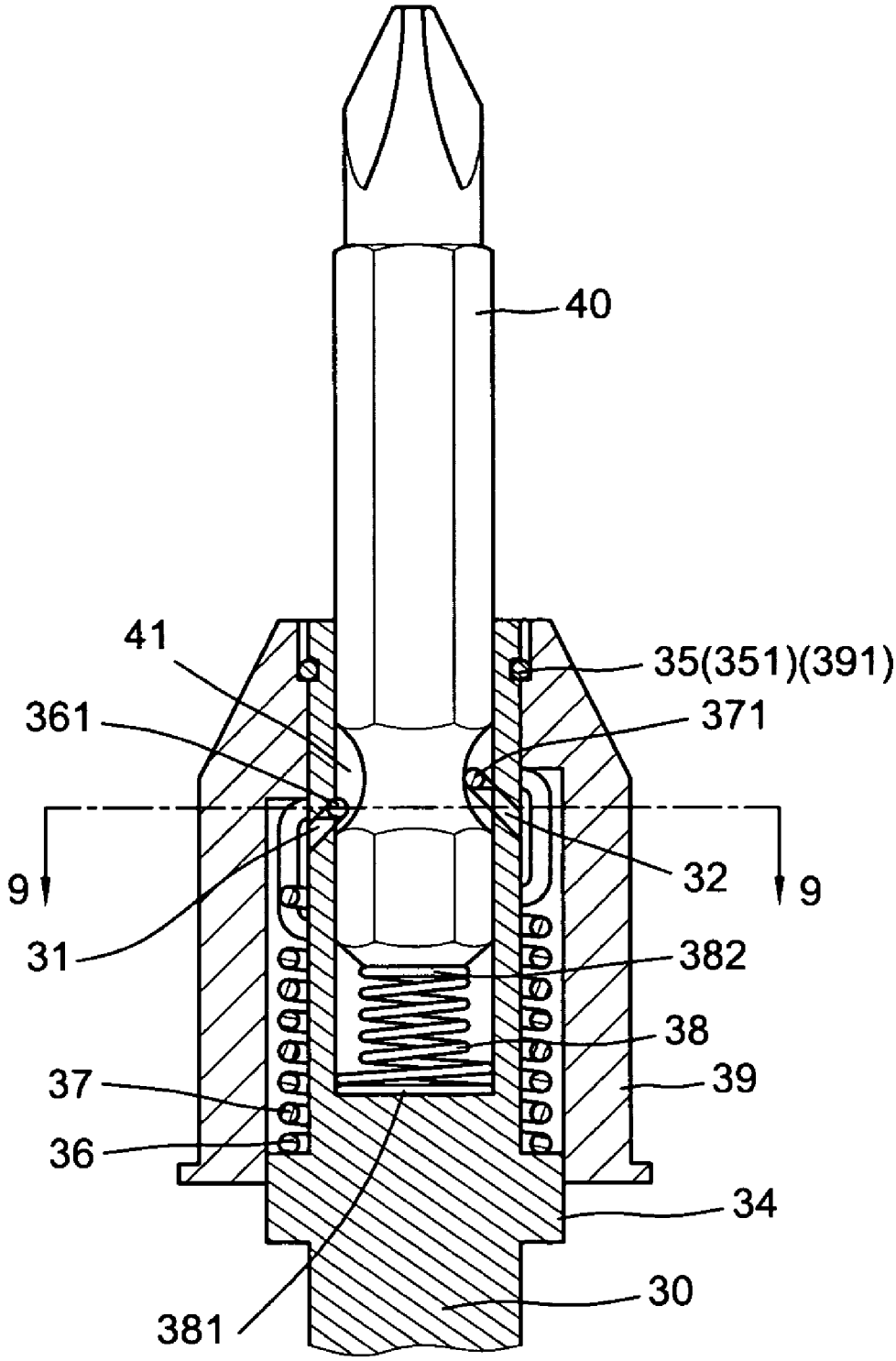
FIG. 9 is a sectional view to show a driving bit is engaged into to wrench.

With reference to FIGS. 7, 8 and 9 of the drawings, the driving bit liking device of the present invention comprises a box wrench 30 having a hexagonal central bore 33 which may be circular, a bottom spring 38 embedded into the central bore 33 against the bottom of the wrench 30 including a large diameter loose lower portion 381 and a less diameter intensive upper portion 382, an annular collar 34 on a lower periphery, a pair of slant slots 31 and 32 form in the opposing middle peripheries at different level and an annular groove 251 in upper periphery abutting the upper rim for positioning a retaining ring 35, a pair of compression springs 36 and 37 sequentially wrapped on the outer periphery each having a transverse checking rod 361 and 371 on the top respectively engaged within the slant slots 31 and 32, a cap wrapped on the outer periphery of the box wrench 30 having a stop shoulder 391 on upper inner periphery retained by the retaining ring 35, a driving-bit 40 (ISO named E type bit) having an annular groove 41 in lower periphery and a driving bit 50 (ISO named C type bit) having a plurality of rhombic concaves 51 respectively formed in the longitudinal angles thereof. These driving bits 40 and 41 have different length and specifications. Note that the checking slots 31 are formed from shallow to deep to facilitate a readily sliding in for checking rods 361 and 371. The depth of the transverse checking rods 361 and 371 inside the box wrench 30 equals to one third to one fifth of the radial length of the box wrench 30 which is normally connected to a handle (not shown).

Figure 10:
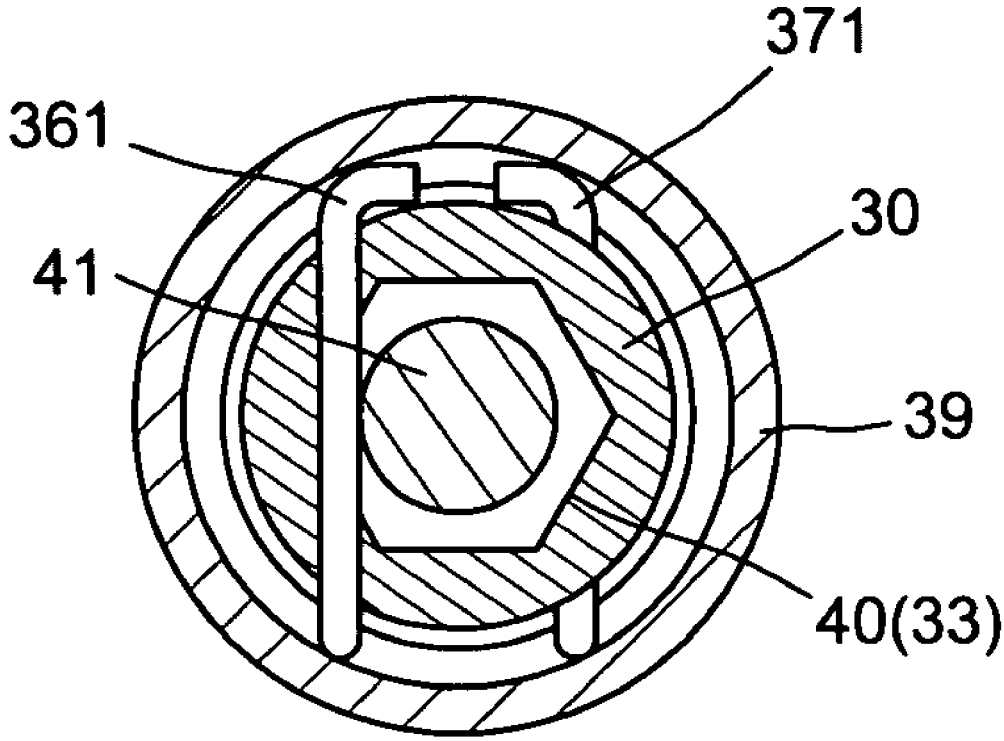
FIG. 10 is a sectional view taken along line 9—9 of FIG. 9.

Referring FIG. 10 and FIG. 9, again insert an E type bit 40 which has an annular groove 41 into the central bore 30 of the box wrench 30, the pair of checking rods under pressure of the bit 40 first retreat backward to permit the bit 40 continuously inserting in until the lower end of the bit 40 reached to the bottom spring 38 and the annular groove 41 engaged with the slant slots 31 and 32, the checking rods 361 and 371 will jump in again to engage within the annular groove 41 under the resilience of the springs 36 and 37. Wherein the checking rod 361 is positioned lower than that of the checking rod 371 so that the checking rod 361 substantially inserts into the annular groove 41 deeper than that of the checking rod 371. Since the bit 40 is secured in the wrench 30, one can rotates the wrench 30 together with the bit 40 to drive a working object.

Figure 11:
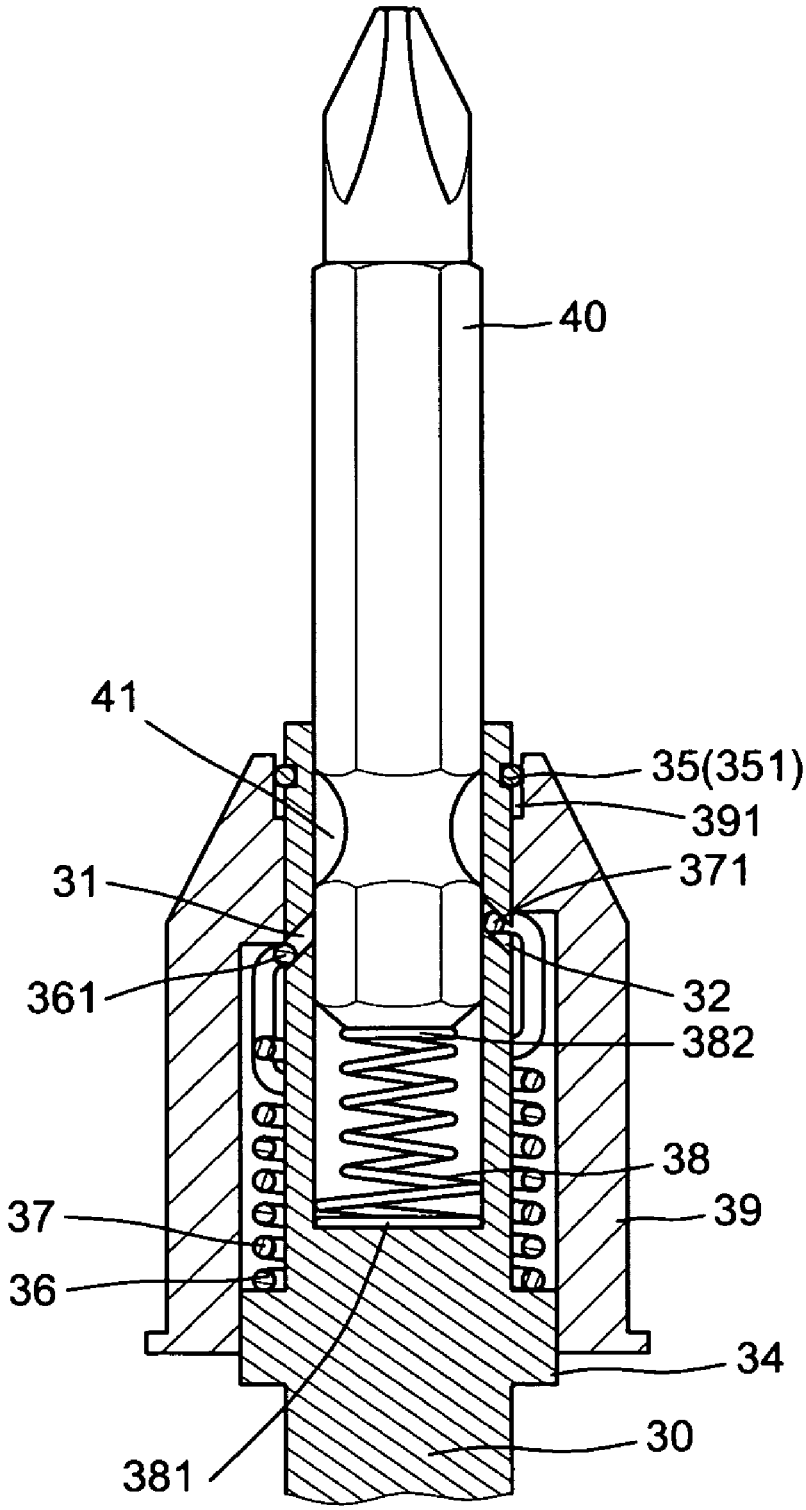
FIG. 11 is a sectional view to show the operation of FIG. 9.

When removes the bit 40 from the wrench 30 (as shown in FIG. 11), press the cap 39 downward to force the pair of checking rods 361 and 371 retreating to disengage with the annular groove 41 so that the bit 40 will be automatically jumped out from the wrench because of the bottom spring 38.

Figure 12:
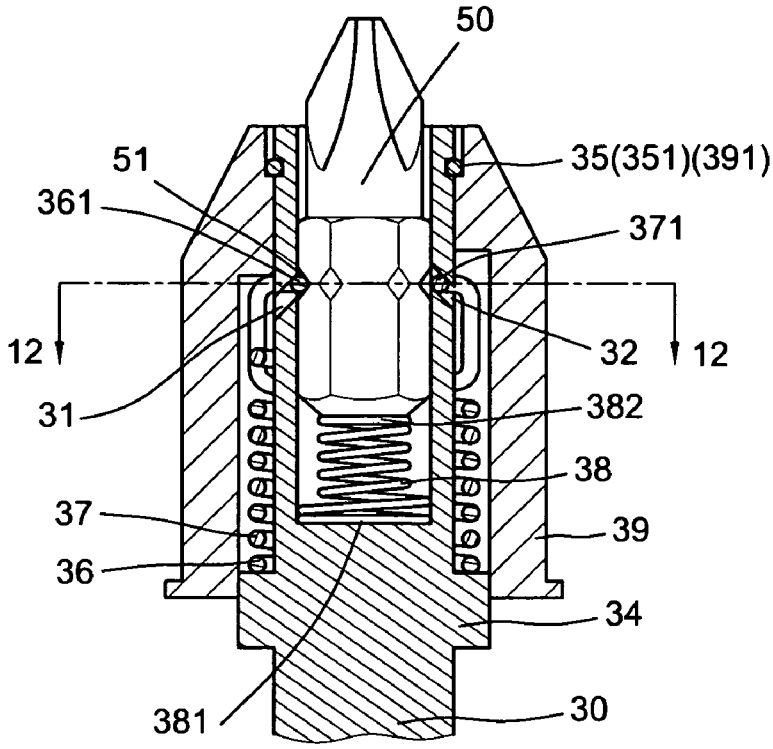
FIG. 12 is a sectional view to show a concaved driving bit engaged into the wrench.
Figure 13:
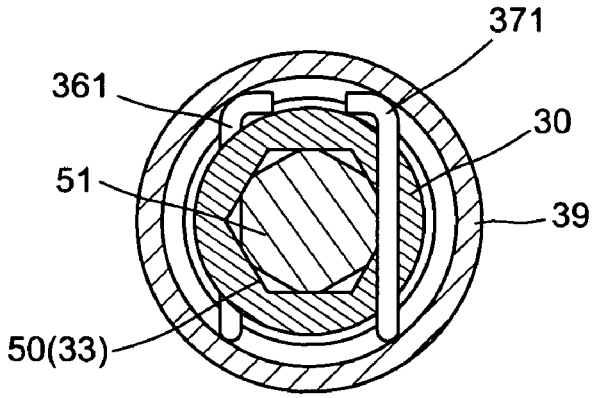
FIG. 13 is a sectional view taken along line 12—12 of FIG. 12.

Referring to FIGS. 12 and 13, if inserts a C type bit 50 into the wrench 30, the process is similar to insert the E type bit 40 as discussed the above. The only different is that the checking rods 361 and 371 respectively engage within the rhombic concaves 51 in angle of the opposing peripheries of the bit 50. Because the checking rod 371 is higher than the checking rod 361, it is strongly checking the rhombic concaves 51.

Figure 14:
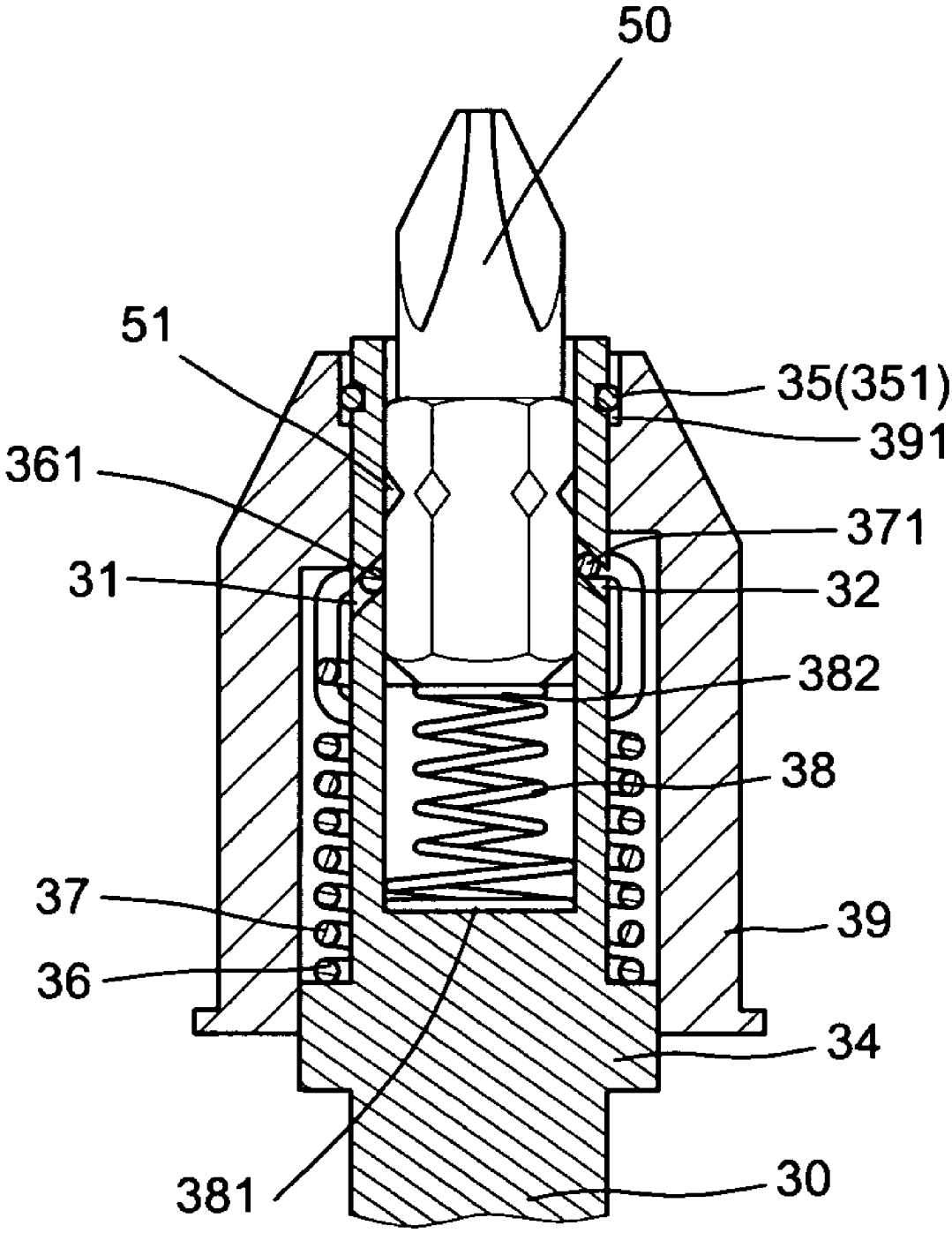
FIG. 14 is a sectional view to show the removal of the concaved driving bit from the wrench.
Figure 15:
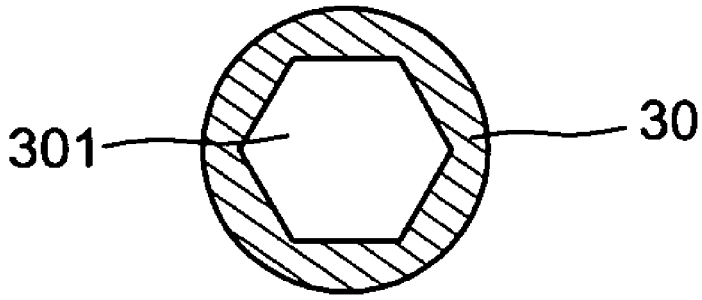
FIG. 15 is a sectional view to show the driving bit acting region in the wrench.
Figure 16:
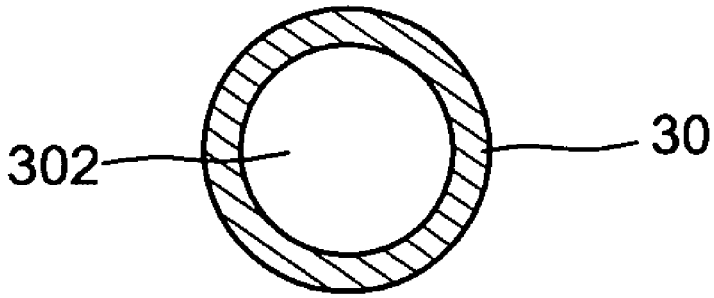
FIG. 16 is a sectional view to show a spring acting region in the wrench.

When removes the bit 50 from the wrench 30 (as shown in FIG. 14), the process is also similar to remove the bit 40 from the wrench 30 as discussed the above. However, here has to supplementarily state that the central bore 33 of the wrench 30 is separated into a hexagonal upper portion 302 and a circular lower portion 301 which is formed to receive the bottom spring 38. Where the hexagon upper portion 302 is provided to engage with the hexagonal bit 40 or 50 (as shown FIGS. 15 and 16).

Figure 17:
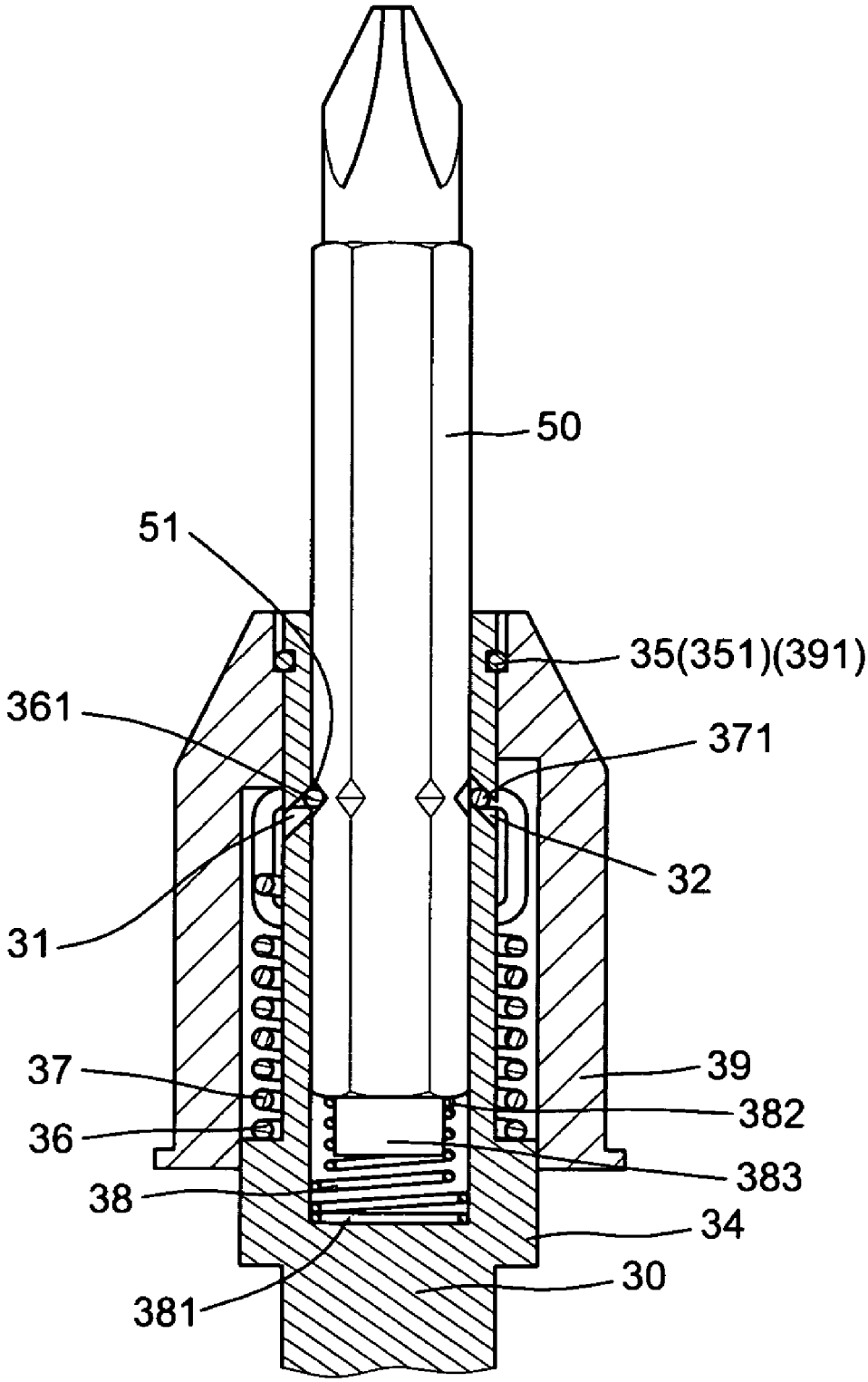
FIG. 17 is a sectional view to show an alternate arrangement for the spring in the wrench.

FIG. 17 shows an alternative arrangement that is engaging a piece of magnet 383 into the intensive upper portion 382 of the bottom spring 38 to transmit the magnetic force into the bit 40 or 50 to attract the working object. Meanwhile, the loose lower portion 381 of the bottom spring 38 will not break off to follow the removal of the bit 40 or 50 because it is firmly engaged with bottom of the wrench 30.

Figure 18:
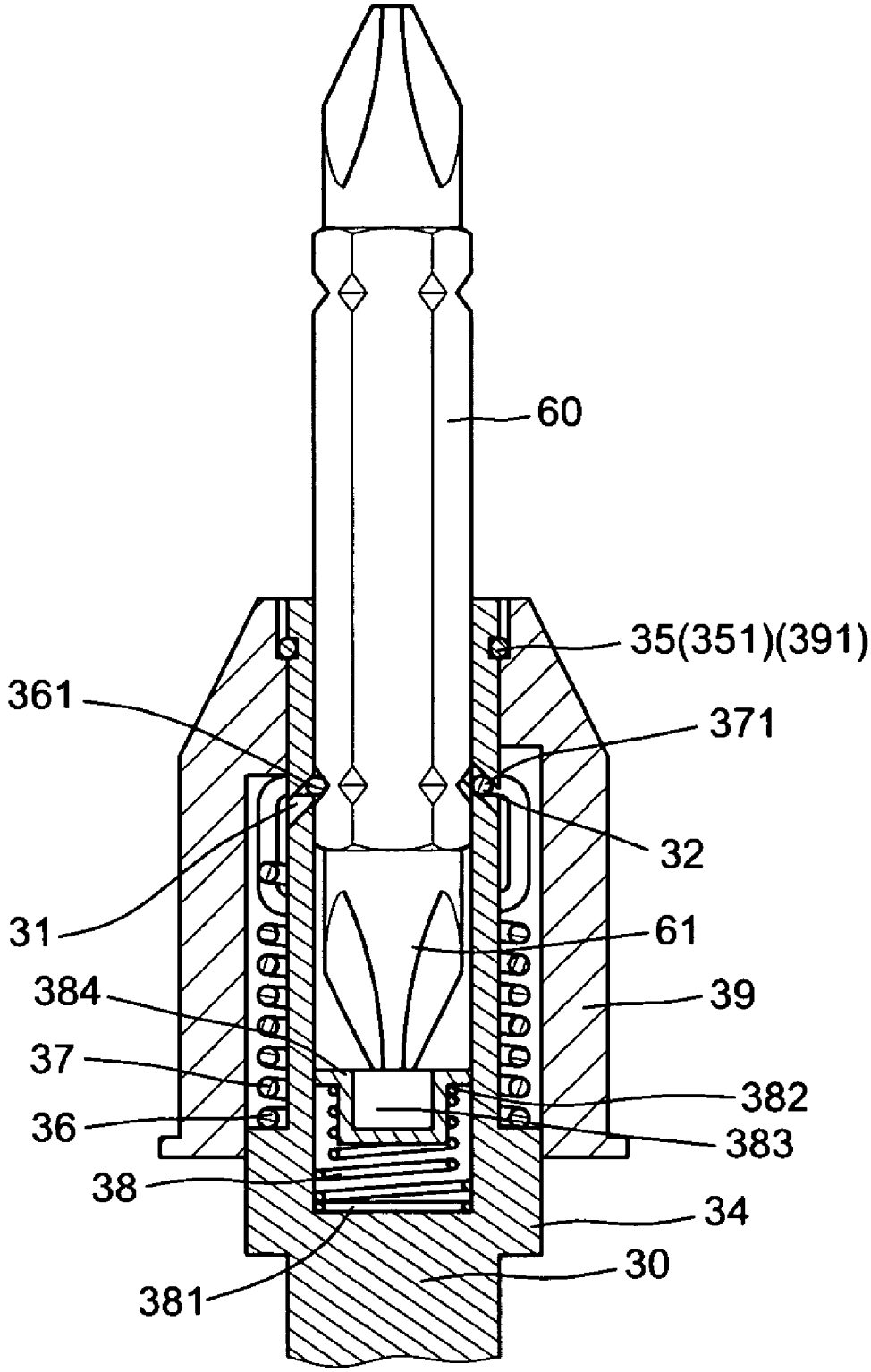
FIG. 18 is a sectional view to show another arrangement for the spring inside the wrench.

FIG. 18 shows another alternate arrangement that is to place a stop plate 384 on the top of the magnet 383, by which the wrench 30 is able to receive a double tips bit 60. This arrangement can prevent the bottom spring 38 from damaged or deformed by the bit 60, but the magnetic force can still transmit into the bit 60. Further, this arrangement also fits to the bit 40 or 50.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A driving bit linking device in a box wrench comprising:

a box wrench connected to a handle at lower end, a central bore which is defined a hexagonal upper section and a circular lower section, a pair of checking slots respectively formed in opposing middle peripheries at different level, an annular collar on a lower periphery and an annular groove in upper periphery abutting upper rim for disposing a retaining ring therein;

a bottom spring disposed in the circular section of said box wrench having a large diameter loose lower portion and a less diameter intensive upper portion;

a pair of compression springs sequentially wrapped on outer periphery of said box wrench stopped against said annular collar and each having a transverse checking rod on top respectively inserted into said hexagonal section through said checking slots;

a cap wrapped on said box wrench having an annular shoulder on upper inner periphery retained by said retaining ring;

a E type bit engaged into the hexagonal section of said box wrench having an annular groove in lower periphery engaged with said transverse checking rods;

a C type bit engaged into the hexagonal section of said box wrench having a rhombic concave in each angle of hexagonal body respectively engageable with said transverse checking rods.

2. The driving bit linking device as recited in claim 1, wherein said checking slots have formed from shallow to deep.

3. The driving bit linking device as recited in claim 1, further has a piece of magnet disposed in the less diameter intensive upper portion of said bottom spring.

4. The driving bit linking device as recited in claim 3, further has a stop plate disposed on top of said magnet.

5. The driving bit linking device as recited in claim 1, further has a double tip driving bit engageable into the hexagonal section of said box wrench.

6. The driving bit linking device as recited in claim 1, wherein the depth of said transverse checking rods inside said wrench equals to one third to one fifth of radial length of said box wrench.

* * * * *